US008360341B2

(12) United States Patent
Machi et al.

(10) Patent No.: US 8,360,341 B2
(45) Date of Patent: Jan. 29, 2013

(54) ATOMIZATION APPARATUS

(75) Inventors: Masaharu Machi, Shijonawate (JP); Hiroshi Suda, Takatsuki (JP); Youhei Ishigami, Yao (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 88 days.

(21) Appl. No.: 12/736,863

(22) PCT Filed: May 14, 2009

(86) PCT No.: PCT/JP2009/059303

§ 371 (c)(1),
(2), (4) Date: Nov. 17, 2010

(87) PCT Pub. No.: WO2009/145099

PCT Pub. Date: Dec. 3, 2009

(65) Prior Publication Data

US 2011/0068193 A1 Mar. 24, 2011

(30) Foreign Application Priority Data

May 27, 2008 (JP) ..... 2008-138658
Sep. 25, 2008 (JP) ..... 2008-246954

(51) Int. Cl.
*B05B 1/24* (2006.01)

(52) U.S. Cl. ..... 239/128; 239/102.1

(58) Field of Classification Search ..... 239/132–132.5, 239/102.1, 102.2, 128

See application file for complete search history.

(56) References Cited

U.S. PATENT DOCUMENTS

| | | | | |
|---|---|---|---|---|
| 4,663,091 | A | | 5/1987 | Seo |
| 4,961,885 | A | * | 10/1990 | Avrahami et al. ..... 261/142 |
| 7,473,298 | B2 | | 1/2009 | Suda et al. |
| 2009/0261185 | A1 | | 10/2009 | Kasuya et al. |

FOREIGN PATENT DOCUMENTS

| | | | |
|---|---|---|---|
| EP | 0844027 | A1 | 5/1998 |
| EP | 1452239 | A1 | 9/2004 |
| JP | 2005-105289 | A | 4/2005 |
| JP | 2007-000402 | A | 1/2007 |
| JP | 2007-239041 | A | 9/2007 |
| WO | WO-2004/105958 | A1 | 12/2004 |
| WO | WO-2007/011035 | A1 | 1/2007 |

OTHER PUBLICATIONS

International Search Report mailed Nov. 9, 2009, and Written Opinion of the International Searching Authority, issued for PCT/JP2009/059303.

* cited by examiner

*Primary Examiner* — Christopher Kim
(74) *Attorney, Agent, or Firm* — Edwards Wildman Palmer LLP; James E. Armstrong, IV; George N. Chaclas

(57) ABSTRACT

Atomization apparatus is configured to produce mist by atomizing liquid after electrolysis to discharge the mist. The apparatus includes a substrate, an electrolysis device and a vibration device. The substrate includes: a liquid receiving part having a liquid storage surface; and a reservoir having a discharge surface. The electrolysis device has an anode and a cathode located at the liquid receiving part. The reservoir holds the liquid after electrolysis obtained from one of the anode and the cathode. The discharge surface is located at the side of the one of the anode and the cathode. The vibration device is configured to vibrate and atomize the liquid after electrolysis held at the reservoir.

17 Claims, 1 Drawing Sheet

ATOMIZATION APPARATUS

TECHNICAL FIELD

The invention relates generally to atomization apparatus and, more particularly, to functional water atomizing apparatus configured to produce mist by atomizing functional water to discharge the mist.

BACKGROUND ART

For example, Japanese Patent Application Publication No. 2005-105289 published on Apr. 21, 2005 discloses a hydrogen water supply device. In this device, in order to effectively produce hydrogenated water (water containing active hydrogen) that is beneficial to a human body, the hydrogenated water is produce at the side of a cathode by electrolyzing water in an electrolytic receptacle. The hydrogenated water has a reduction action, and accordingly can display effects of anti-aging and long storage of food.

Similarly, by electrolyzing water, oxygenated water (water containing oxygen) is produced at the side of an anode. The oxygenated water can get rid of insufficient oxygen of cells, and also display soothing effect and so on. Hereinafter, hydrogenated water or oxygenated water is also referred to as "functional water".

In order to supply functional water over, e.g., a skin surface of a user or a room, it is desirable to atomize functional water.

For example, PCT International Publication No. WO 2004/105958 A1 (U.S. Pat. No. 7,473,298 B2) published on Dec. 9, 2004 discloses a method of creating an environment where a mist of charged fine particulate water is dispersed. The mist is generated by applying high voltage across electrodes while supplying water between the electrodes with a water supply unit. The charged fine particulate water contains at least one of hydroxyl radicals, superoxides, nitrogen monoxide radicals and oxygen radicals.

However, the mist is discharged from the tip of a spicula electrode (a second electrode), and accordingly a plurality of spicula electrodes are required in order to supply functional water to, e.g., every corner of a room. Consequently, the atomization device for generating the mist grows in size and thereby difficult to apply to various apparatus.

It is, therefore, desired that mist obtained by atomizing functional water is widely discharged without a plurality of spicula electrodes and an electrolytic receptacle that affect dimensions.

DISCLOSURE OF THE INVENTION

It is an object of the present invention to widely discharge mist obtained from the liquid after electrolysis without a plurality of spicula electrodes and an electrolytic receptacle that affect dimensions.

The present invention is atomization apparatus that is configured to produce mist by atomizing liquid to discharge the mist. The atomization apparatus comprises a liquid receiving part, a liquid supply device, an electrolysis device, a reservoir and a vibration device. The liquid supply device is configured to supply liquid to the liquid receiving part. The electrolysis device has an anode and a cathode which are located at the liquid receiving part, and is configured to electrolyze the liquid supplied to the liquid receiving part by applying voltage across the anode and the cathode. The reservoir is configured to hold the liquid after electrolysis obtained from one of the anode and the cathode. The vibration device is configured to vibrate said liquid after electrolysis held at the reservoir. The atomization apparatus further comprises a substrate including a liquid storage surface and a discharge surface. The liquid receiving part comprises the liquid storage surface. The reservoir comprises the discharge surface that is located at the side of said one of the anode and the cathode. The vibration device is configured to produce mist by vibrating and atomizing said liquid after electrolysis and to discharge the mist by surface discharge from the discharge surface.

In this invention, since the mist is discharged by surface discharge from the discharge surface, it is possible to widely discharge mist obtained from the liquid after electrolysis without a plurality of spicula electrodes and an electrolytic receptacle that affect dimensions.

In an embodiment, the reservoir has a flat-shaped porous structure and is embedded in the substrate so as to adjoin the liquid receiving part. Preferably, the reservoir comprises a felt, a porous ceramics or a porous sintered metal. In this embodiment, the reservoir can pull in said liquid after electrolysis from the liquid receiving part, while at the same time can hold the liquid after electrolysis. Moreover, the top of the reservoir functions as the discharge surface, and accordingly mist can be discharged by surface discharge from the discharge surface.

In an embodiment, the liquid is water. The reservoir is also located at the side of the cathode so as to obtain hydrogenated water by said electrolysis and configured to pull in the hydrogenated water by capillary movement. In this embodiment, the mist obtained from hydrogenated water can be discharged.

In an embodiment, the liquid is water. The reservoir is also located at the side of the anode so as to obtain oxygenated water by said electrolysis and configured to pull in the oxygenated water by capillary movement. In this embodiment, the mist obtained from oxygenated water can be discharged.

In an embodiment, a face of the substrate functions as a vibrating surface capable of propagating surface elastic waves. The vibration device also comprises an oscillator for transmitting surface elastic waves to the reservoir through the vibrating surface. In this embodiment, said liquid after electrolysis can be atomized by the surface elastic waves, and mist can be produced from the liquid after electrolysis.

In an embodiment, the vibration device comprises an ultrasonic transducer. The ultrasonic transducer is also located on the back of the reservoir in a face of the substrate. In this embodiment, the ultrasonic transducer is activated and thereby the reservoir receives ultrasonic vibration, and accordingly said liquid after electrolysis can be atomized by the ultrasonic vibration, and mist can be produced from the liquid after electrolysis.

In an embodiment, the liquid supply device comprises a cooling device configured to produce the liquid from dew condensation water. In this embodiment, the trouble that a user supplies water to the atomization apparatus can be saved.

BRIEF DESCRIPTION OF THE DRAWINGS

Preferred embodiments of the invention will now be described in further details. Other features and advantages of the present invention will become better understood with regard to the following detailed description and accompanying drawings where.

BEST MODE FOR CARRYING OUT THE INVENTION

Figure 1:
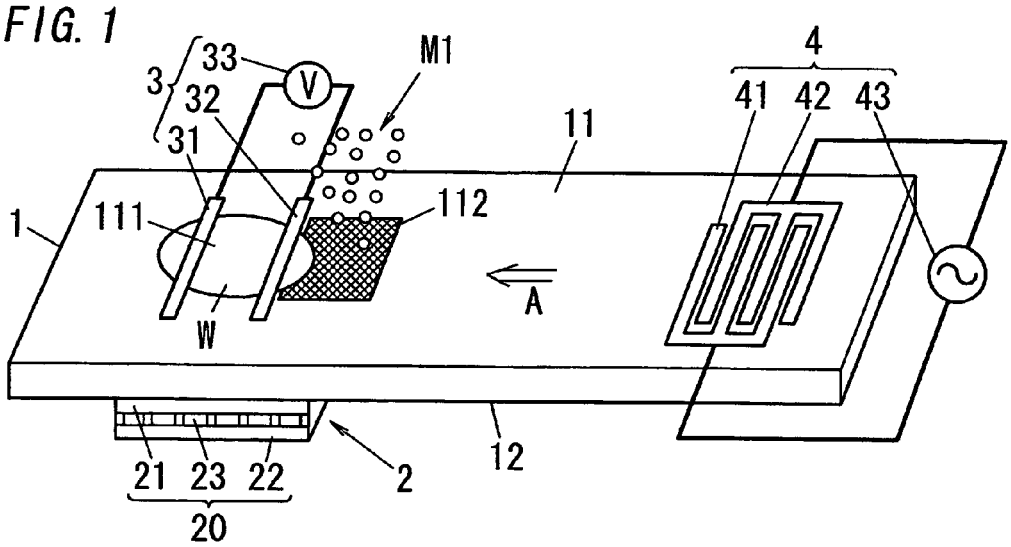
FIG. 1 is a schematic diagram of atomization apparatus in accordance with an embodiment of the present invention.

FIG. 1 shows atomization apparatus in accordance with an embodiment of the present invention. This atomization apparatus includes a substrate 1, a liquid supply device 2, an electrolysis device 3 and a vibration device 4, and is configured to produce mist by atomizing functional water after electrolysis of liquid (e.g., water) to discharge the mist. The atomization apparatus is driven with an external controller (not shown).

The substrate 1 is in the shape of a long thin board including first and second faces 11 and 12 which are opposite faces, and includes a liquid receiving part 111 and a reservoir 112. For example, the substrate 1 is made of materials capable of propagating heat and vibration (e.g., lithium niobate, lithium tantalate or the like). Therefore, the first face 11 of the substrate 1 functions as a vibrating surface capable of propagating surface elastic waves.

The liquid receiving part 111 includes, for example, a hollow having a hollow surface (a liquid storage surface) capable of storing water (W), and is located at the side of a first end (left end in FIG. 1) of the first face 11 in the length direction of the substrate 1.

The reservoir 112 is located at the side of center of the first face 11 so as to adjoin the liquid receiving part 111, and configured to hold functional water (liquid after electrolysis). The top of the reservoir 112 also functions as a discharge surface for discharging mist. That is, the reservoir 112 is configured to hold the liquid after electrolysis obtained from one of an anode 31 and a cathode 32 to be described, and also has a discharge surface located at the side of the one of the anode 31 and the cathode 32 in the first face 11. For example, the reservoir 112 has a flat-shaped porous structure, and is embedded in the first face 11 of the substrate 1 so that the reservoir adjoins the liquid receiving part 111 and the discharge surface is flush with the first face 11. The reservoir 112 includes a felt. However, not limited to this, the reservoir of the present invention may comprise a porous ceramics, a porous sintered metal or the like. In the example of FIG. 1, the reservoir 112 is located at the side of the cathode 32, and accordingly configured so that it can pull in functional water obtained by electrolysis, namely hydrogenated water by capillary movement and hold the functional water for a long time.

The liquid supply device 2 is configured to supply water to the liquid receiving part 111 in the substrate 1. For example, the liquid supply device 2 includes a cooling device configured to produce water from dew condensation water, and the cooling device is located on the back of the liquid receiving part 111 in the second face 12 of the substrate 1. The cooling device is, but not limited to, a Peltier unit 20 that is formed of a cooling substrate 21, a radiating substrate 22 and Peltier devices 23 arranged between them. The cooling substrate 21 is located (fixed) on the back of the liquid receiving part 111 in the second face 12 of the substrate 1. Accordingly, the Peltier unit 20 is energized with an external power supply (not shown) and thereby the liquid receiving part 111 is cooled with the cooling substrate 21 and then dew condensation water is produced on the hollow surface of the substrate 1.

The electrolysis device 3 includes the anode 31 and the cathode 32 which are isolated from the substrate 1 and located at the liquid receiving part 111. The anode 31 and the cathode 32 are fixed to the hollow surface so as to be soaked in water in the liquid receiving part 111, and also connected to an external DC (direct current) power supply 33. In short, the electrolysis device 3 is configured to electrolyze the water supplied to the liquid receiving part 111 by applying DC voltage across the anode 31 and the cathode 32. In the example of FIG. 1, the anode 31 is located at the side of the first end of the first face 11, and the cathode 32 is located at the side of the center of the first face 11.

The vibration device 4 is configured to vibrate functional water held at the reservoir 112. In the embodiment, since the reservoir 112 has the discharge surface, the vibration device 4 is configured to produce mist by vibrating and atomizing functional water and to discharge the mist by surface discharge from the discharge surface. For example, the vibration device 4 includes an oscillator for transmitting surface elastic waves to the reservoir 112 through the vibrating surface (the first face 11) of the substrate 1. In the example of FIG. 1, the oscillator is formed of two comb electrodes 41 and 42 placed opposite each other. The electrodes 41 and 42 are located at the side of a second end (the right end in FIG. 1) of the first face 11, and also connected to an external high frequency power supply 43. Accordingly, if high frequency voltage having, but not limited to, a frequency in the range from 1 MHz to 500 MHz is applied across the electrodes 41 and 42 from the power supply 43, the electrodes 41 and 42 vibrates and generates surface elastic waves. The surface elastic waves are transmitted to the reservoir 112 through the vibrating surface of the substrate 1 (see "A" in FIG. 1).

An operation example of the atomization apparatus under the external controller is explained. For example, a water detection sensor (not shown) is located in the liquid receiving part 111, and the external controller judges whether or not predetermined amount of water is stored in the liquid receiving part 111 through the water detection sensor. However, not limited to this, the external controller may judge whether or not predetermined amount of water is stored in the liquid receiving part 111 through a timer.

If the atomization apparatus is activated, the liquid supply device 2 (Peltier unit 20) is energized. Thereby, the liquid receiving part 111 is cooled with the cooling substrate 21 and then dew condensation water, namely water is produced on the hollow surface of the substrate 1. After predetermined amount of water is stored in the liquid receiving part 111, DC voltage is applied across the anode 31 and the cathode 32, and the water in the liquid receiving part 111 is electrolyzed. The hydrogenated water obtained by electrolysis is pulled in the reservoir 112 (felt) by capillary movement, and held at the reservoir 112 at the same time.

High frequency voltage is subsequently applied across the electrodes 41 and 42, and the electrodes 41 and 42 vibrate and generate surface elastic waves. The surface elastic waves are transmitted to the reservoir 112 through the vibrating surface (the first face 11) of the substrate 1, and the hydrogenated water in the reservoir 112 is atomized by the surface elastic waves. Thereby, mist (M1) is produced and then discharged by surface discharge from the discharge surface of the reservoir 112.

Thus, by vibrating and atomizing hydrogenated water, mist is generated and then discharged by surface discharge from the discharge surface of the reservoir 112, and accordingly it is possible to widely discharge mist obtained from hydrogenated water without a plurality of spicula electrodes and an electrolytic receptacle that affect dimensions. The mist obtained from hydrogenated water has a reduction action, and accordingly can display effects of anti-aging and long storage of food. The atomization apparatus can be also applied to various apparatus as a unit. Moreover, since there is no need to supply water to the atomization apparatus, customer-friendly atomization apparatus can be provided.

Figure 2:
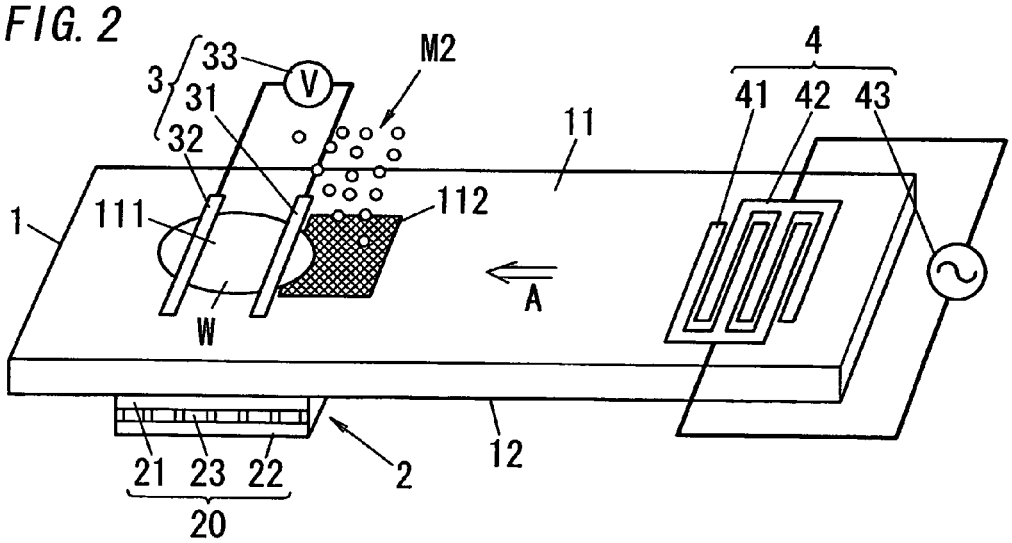
FIG. 2 is a schematic diagram of atomization apparatus in accordance with an embodiment of the present invention.

In an embodiment, as shown in FIG. 2, the atomization apparatus is configured to discharge the mist (M2) obtained from oxygenated water. That is, the reservoir 112 is located at the side of the anode 31 so as to obtain oxygenated water by electrolysis, and configured to pull in the oxygenated water by capillary movement. In the example of FIG. 2, the atomization apparatus is different from that in FIG. 1 in that the cathode 32 is located at the side of the first end of the first face 11 and the anode 31 is located at the side of the center of the first face 11. For the purpose of clarity, like kind elements are assigned the same reference numerals as depicted in the embodiment of FIG. 1.

In the atomization apparatus of FIG. 2, if DC voltage is applied across the anode 31 and the cathode 32, the water in the liquid receiving part 111 is electrolyzed and the oxygenated water is pulled in and held at the reservoir 112 by capillary movement. Subsequently, if high frequency voltage is applied across the electrodes 41 and 42, surface elastic waves are transmitted to the reservoir 112 and the oxygenated water in the reservoir 112 is atomized. Thereby, mist (M2) is produced and then discharged by surface discharge from the discharge surface of the reservoir 112. In this embodiment, the mist obtained from the oxygenated water can get rid of insufficient oxygen of cells, and also display soothing effect and so on.

Figure 3:
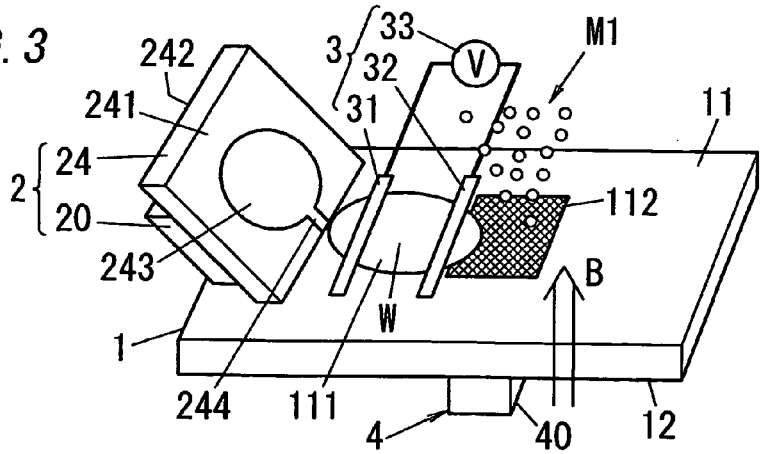
FIG. 3 is a schematic diagram of atomization apparatus in accordance with an embodiment of the present invention.

FIG. 3 shows atomization apparatus in accordance with an embodiment of the present invention. This atomization apparatus includes a substrate 1, a liquid supply device 2, an electrolysis device 3 and a vibration device 4, and is configured to produce mist by atomizing functional water after electrolysis of liquid (e.g., water) to discharge the mist. The substrate 1 and the electrolysis device 3 are configured in almost the same way as those of FIG. 1, respectively, but the liquid supply device 2 and the vibration device 4 are different from those of FIG. 1. For the purpose of clarity, like kind elements are assigned the same reference numerals as depicted in the embodiment of FIG. 1. However, not limited to the example of FIG. 3, an anode 31 and a cathode 32 may be arranged in the same way as those of FIG. 2.

The liquid supply device 2 includes a cooling device and a cooling board 24, and is located at the side of a first end (the left end in FIG. 3) of the first face 11 in the length direction of the rectangular substrate 1. The cooling device is, for example, a Peltier unit 20. The cooling board 24 is in the shape of a thin board including first and second faces 241 and 242 which are opposite faces, and includes a water producing part 243 and a water supply channel 244. The water producing part 243 includes a hollow having a hollow surface formed on the first face 241 of the cooling board 24, and the water supply channel 244 includes a slit formed from the hollow to an edge of the cooling board 24. The cooling board 24 is located on the first face 11 of the substrate 1 so that the first face 241 is a slope having an obtuse angle with respect to the first face 11 and the water supply channel 244 is connected to the liquid receiving part 111 of the substrate 1. The cooling substrate of the Peltier unit 20 is fixed to the second face 242 of the cooling board 24. Accordingly, if the Peltier unit 20 is energized from an external power supply (not shown), the cooling board 24 is cooled with the cooling substrate of the Peltier unit 20 and then dew condensation water is produced on the hollow surface of the cooling board 24. Thereby, water is stored in the hollow (the water producing part 243) of the cooling board 24, and the water is fed to the liquid receiving part 111 of the substrate 1 through the water supply channel 244. In an example, the water in the water producing part 243 may be fed to the liquid receiving part 111 of the substrate 1 by capillary movement of a porous member.

The vibration device 4 includes an ultrasonic transducer 40 that is located on the back of the reservoir 112 in the second face 12 of the substrate 1. In this vibration device 4, ultrasonic vibration from the ultrasonic transducer 40 is speedily transmitted to the reservoir 112 through the thickness of the substrate 1 (see "B" in FIG. 2). Thereby, functional water (hydrogenated water) in the reservoir 112 is atomized and then mist (M1) is produced and discharge by surface discharge from the discharge surface of the reservoir 112.

Although the present invention has been described with reference to certain preferred embodiments, numerous modifications and variations can be made by those skilled in the art without departing from the true spirit and scope of this invention.

The invention claimed is:

1. Atomization apparatus, configured to produce mist by atomizing liquid to discharge the mist, wherein the atomization apparatus comprises:

a liquid receiving part;

a liquid supply device configured to supply liquid to the liquid receiving part;

an electrolysis device having an anode and a cathode which are located at the liquid receiving part, said electrolysis device being configured to electrolyze the liquid supplied to the liquid receiving part by applying voltage across the anode and the cathode;

a reservoir configured to hold the liquid after electrolysis obtained from one of the anode and the cathode; and a vibration device configured to vibrate said liquid after electrolysis held at the reservoir, wherein the atomization apparatus further comprises a substrate including a liquid storage surface and a discharge surface, wherein the liquid receiving part comprises the liquid storage surface, wherein the reservoir comprises the discharge surface that is located at a side of said one of the anode and the cathode, wherein the vibration device is configured to produce mist by vibrating and atomizing said liquid after electrolysis and to discharge the mist by surface discharge from the discharge surface, wherein the reservoir has a flat-shaped porous structure and is embedded in the substrate so as to adjoin the liquid receiving part.

2. The atomization apparatus of claim 1, wherein the reservoir is a felt, a porous ceramics or a porous sintered metal.

3. The atomization apparatus of claim 2, wherein a face of the substrate functions as a vibrating surface capable of propagating surface elastic waves, wherein the vibration device comprises an oscillator for transmitting surface elastic waves to the reservoir through the vibrating surface.

4. The atomization apparatus of claim 2 wherein the vibration device comprises an ultrasonic transducer, said ultrasonic transducer being located on the back of the reservoir in a face of the substrate.

5. The atomization apparatus of claim 2, wherein the liquid supply device comprises a cooling device configured to produce the liquid from dew condensation water.

6. The atomization apparatus of claim 1, wherein the liquid is water, wherein the reservoir is located at the side of the cathode such that the reservoir obtains hydrogenated water by said electrolysis, the reservoir being configured to pull in the hydrogenated water by capillary movement.

7. The atomization apparatus of claim 6, wherein a face of the substrate functions as a vibrating surface capable of propagating surface elastic waves, wherein the vibration device comprises an oscillator for transmitting surface elastic waves to the reservoir through the vibrating surface.

8. The atomization apparatus of claim 6, wherein the vibration device comprises an ultrasonic transducer, said ultrasonic transducer being located on the back of the reservoir in a face of the substrate.

9. The atomization apparatus of claim 6, wherein the liquid supply device comprises a cooling device configured to produce the liquid from dew condensation water.

10. The atomization apparatus of claim 1, wherein the liquid is water, wherein the reservoir is located at the side of the anode such that the reservoir obtains oxygenated water by said electrolysis, the reservoir being configured to pull in the oxygenated water by capillary movement.

11. The atomization apparatus of claim 10, wherein a face of the substrate functions as a vibrating surface capable of propagating surface elastic waves, wherein the vibration device comprises an oscillator for transmitting surface elastic waves to the reservoir through the vibrating surface.

12. The atomization apparatus of claim 10, wherein the vibration device comprises an ultrasonic transducer, said ultrasonic transducer being located on the back of the reservoir in a face of the substrate.

13. The atomization apparatus of claim 10, wherein the liquid supply device comprises a cooling device configured to produce the liquid from dew condensation water.

14. The atomization apparatus of claim 1, wherein a face of the substrate functions as a vibrating surface capable of propagating surface elastic waves, wherein the vibration device comprises an oscillator for transmitting surface elastic waves to the reservoir through the vibrating surface.

15. The atomization apparatus of claims 1, wherein the vibration device comprises an ultrasonic transducer, said ultrasonic transducer being located on the back of the reservoir in a face of the substrate.

16. The atomization apparatus of claim 1, wherein the liquid supply device comprises a cooling device configured to produce the liquid from dew condensation water.

17. Atomization apparatus, configured to produce mist by atomizing liquid to discharge the mist, wherein the atomization apparatus comprises:

a liquid receiving part;

a liquid supply device configured to supply liquid to the liquid receiving part;

an electrolysis device having an anode and a cathode which are located at the liquid receiving part, said electrolysis device being configured to electrolyze the liquid supplied to the liquid receiving part by applying voltage across the anode and the cathode;

a reservoir configured to hold the liquid after electrolysis obtained from one of the anode and the cathode; and a vibration device configured to vibrate said liquid after electrolysis held at the reservoir, wherein the atomization apparatus further comprises a substrate including a liquid storage surface and a discharge surface, wherein the liquid receiving part comprises the liquid storage surface, wherein the reservoir comprises the discharge surface that is located at a side of said one of the anode and the cathode, wherein the vibration device is configured to produce mist by vibrating and atomizing said liquid after electrolysis and to discharge the mist by surface discharge from the discharge surface, wherein the liquid supply device comprises a cooling device configured to produce the liquid from dew condensation water.

* * * * *